US010799012B2

(12) United States Patent
Uriarte

(10) Patent No.: US 10,799,012 B2
(45) Date of Patent: Oct. 13, 2020

(54) COMBINATION BACKPACK WITH REMOVABLE BACK SUPPORT

(71) Applicant: Travis Uriarte, Marina del Rey, CA (US)

(72) Inventor: Travis Uriarte, Marina del Rey, CA (US)

(73) Assignee: Travis Uriarte, Los Angeles, CA (US)

( * ) Notice: Subject to any disclaimer, the term of this patent is extended or adjusted under 35 U.S.C. 154(b) by 0 days.

(21) Appl. No.: 16/208,574

(22) Filed: Dec. 4, 2018

(65) Prior Publication Data

US 2020/0170389 A1 Jun. 4, 2020

(51) Int. Cl.

| | |
|---|---|
| ***A45F 3/08*** | (2006.01) |
| ***A45F 3/04*** | (2006.01) |
| *A45F 3/12* | (2006.01) |

(52) U.S. Cl.
CPC ..... *A45F 3/08* (2013.01); *A45F 3/047* (2013.01); *A45F 2003/122* (2013.01)

(58) Field of Classification Search
CPC ..... A45F 3/08; A45F 3/047; A45F 2003/122
USPC ..... 224/642
See application file for complete search history.

(56) References Cited

U.S. PATENT DOCUMENTS 9,578,953 B2 * 2/2017 Chueh ..... A45F 3/04

* cited by examiner

*Primary Examiner* — Corey N Skurdal

(57) ABSTRACT

A combination backpack with removable back support has a backpack portion and a back support portion which are detachably connected to each other. This allows for use of a back support and backpack both together and separately, by utilizing a back support while wearing a backpack when connected and utilizing a back support separately on a seat or chair when detached. The back support portion will attach to the outside of the backpack component.

6 Claims, 7 Drawing Sheets

COMBINATION BACKPACK WITH REMOVABLE BACK SUPPORT

CROSS-REFERENCE TO RELATED APPLICATIONS

This application claims the benefit of provisional patent application Ser. No. 65/594,950, filed Dec. 5, 2017, by the present inventor, which is incorporated by reference in its entirety.

FEDERALLY SPONSORED RESEARCH not applicable

REFERENCE TO SEQUENCE LISTING not applicable

BACKGROUND

A backpack is a versatile item used to carry everyday items for school, commute, and numerous recreational interests including but not limited to gym, hiking, and cycling. This versatility results in a wide range of total weight and duration a load must be carried/supported by the user. Higher loads, poorly distributed loads, and loads carried for greater duration place greater demands on the spine and can contribute to back pain.

Prior art has made attempts to enhance the ergonomic relationship between a backpack and its user to reduce back strain/stress. However, the ergonomic benefit of prior art ends once the backpack is removed; for example, when the user removes the backpack to perform a seated task or activity. This often returns the spine to a less favorable position since most seats and chairs lack sufficient ergonomics to adequately support the spine. And while this could potentially be mitigated by bringing an existing portable back support, doing so would require both remembering to bring it and the inconvenience of carrying an additional item. Additionally, many back supports in prior art are intended to remain on one chair such as in a home or office and thus do not always work well on chairs and seats in the community. These among other barriers to bringing an additional item such as a back support are generally too impractical and problematic for those who do not yet have back pain.

Back supports are well known in the art. These devices aim to reduce back stress/strain by improving anatomical alignment of the spine and thus helping to alleviate back pain. This is an important consideration given that low back pain causes more global disability than any other health problem and results in substantial personal, community, and financial burdens globally. And not surprisingly, back pain is a common complaint of seated persons. While prior art addresses the users back position and ability to be secured to various chairs, no prior art addresses the need for convenient portability and transferability described in the above paragraph. Given the variability of surfaces people sit on, a back support that is easily transportable by existing on something already carried by the user such as a backpack can greatly improve usage, helping to maintain improved anatomical alignment of the spine for a greater portion of the day, helping to reduce back stress and pain.

Patent Search:

Patent searches were conducted in Field of Classification Search USPTO. None was found to be similar to this embodiment

USPTO

Patent searches were conducted using terms listed below. Patents most similar to this embodiment were examined. See list below for explanation of why the most similar patents are different from this embodiment.

1. Backpack—9588 hits/patents; 2 were remotely similar though 1 utilized a removeable cushion, not an ergonomic back support. This cushion is also not utilized while wearing the backpack. Another patent utilized a lumbar support plate, though was not detachably connected or capable of being utilized on many sitting surfaces.
2. Ergonomic backpack—16 hits; none included this unique detachability for ergonomic application on many surfaces in addition to the backpack itself.
3. Back support—13162 hits; none included this unique backpack combination for transportability and application on many sitting surfaces
4. Lumbar support—2597 hits; none included this unique backpack combination for transportability and application on many sitting surfaces
5. Spine support—614 hits; none included this unique backpack combination for transportability and application on many sitting surfaces
6. Posture correction—276 hits. none were similar.

SUMMARY OF THE INVENTION

Before the present systems and methods are described, it is to be understood that this application is not limited to the particular systems and methodologies described, as there can be multiple possible embodiments which are not expressly illustrated in the present disclosures. It is also to be understood that the terminology used in the description is for the purpose of describing the particular versions or embodiments only, and is not intended to limit the scope of the present application.

The Applicants combination backpack with removable back support addresses improving alignment of the spine in a novel arrangement, configuration, and combination. A back support portion will attach to a backpack portion. This new combination addresses a never before considered aspect of backpack ergonomics by utilizing a back support in a conveniently portable and transferable way. For example, if it is desired to only use a back support portion and not the entire backpack combination, a user may detach said back support portion for separate use on a seat or chair. This allows for convenient and separate application of a back support portion on a wide variety of seats or chairs in a user's respective environment when said backpack portion is removed. The novel physical combination is not expressly suggested nor implied in prior art. The Applicants combination backpack with removable back support solves the problem of suboptimal positioning and alignment of the spine during sitting that cannot simply be solved by owning an ergonomic chair, since people are often forced to be away from such a chair and must sit on a wide variety of different seating. The present invention also allows the user to purchase one product that can serve more than one purpose or need. A backpack is an item many people already use, which will make utilization of said back support portion very convenient since nothing additional needs to be brought or carried, which would be the case with existing back supports. With prolonged sitting being recognized as a contributing factor in the high prevalence of back pain, increasing utilization of a back support may help reduce this incidence.

This summary is provided to introduce a selection of concepts in a simplified form that are further disclosed in the detailed description of the invention. This summary is not intended to identify key or essential inventive concepts of the claimed subject matter, nor is it intended for determining the scope of the claimed subject matter.

BRIEF DESCRIPTION OF THE FIGURES

The figures and descriptions are not drawn to scale, only represent a potential embodiment, and are for illustrative purposes only.

REFERENCE NUMERALS

Figure 1:
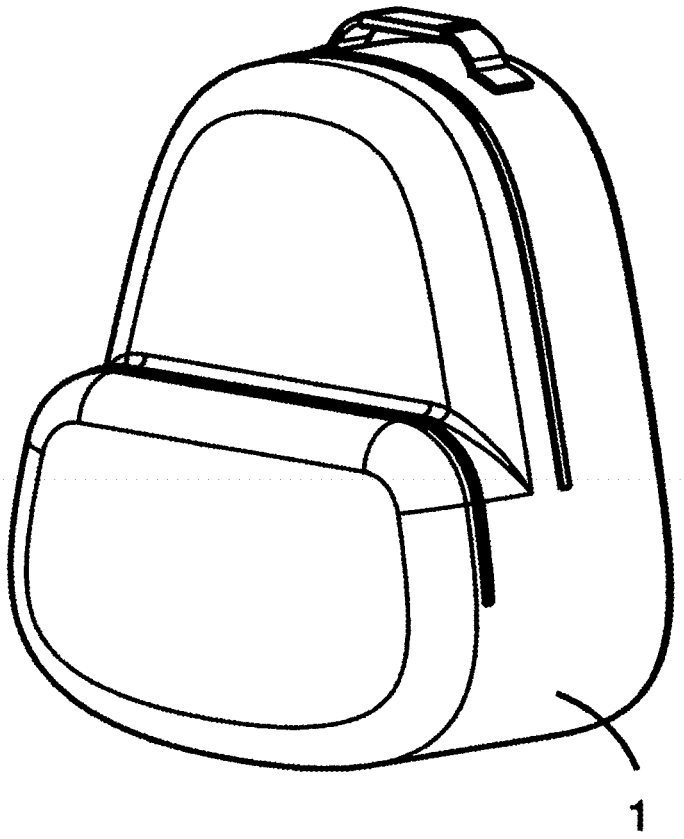
FIG. 1. Exemplarily illustrates a front view of a backpack portion capable of receiving an attachable back support portion, according to a potential embodiment. Shoulder strap(s) not pictured for better visibility.
Figure 2A:
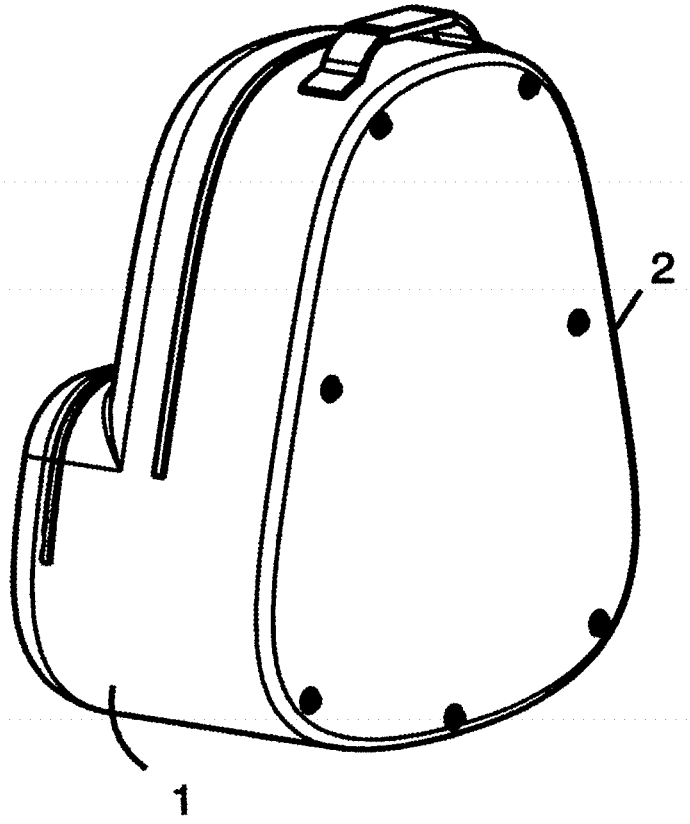
FIG. 2A. Exemplarily illustrates a rear view of a backpack portion as identified in FIG. 1 capable of receiving an attachable back support portion with a connecting means such as fastening, snap hooks, or magnets.
Figure 2B:
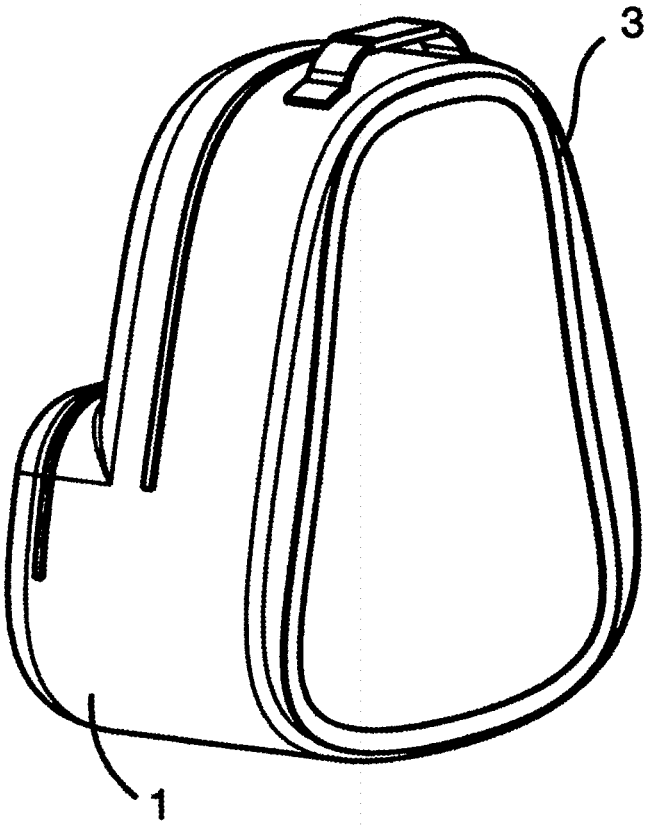
FIG. 2B. Exemplarily illustrates a rear view of a backpack portion as identified in FIG. 1 capable of receiving an attachable back support portion with an interlocking connecting means via snapping the perimeter of the frame of said back support portion into the perimeter of the frame of said backpack portion.
Figure 3A:
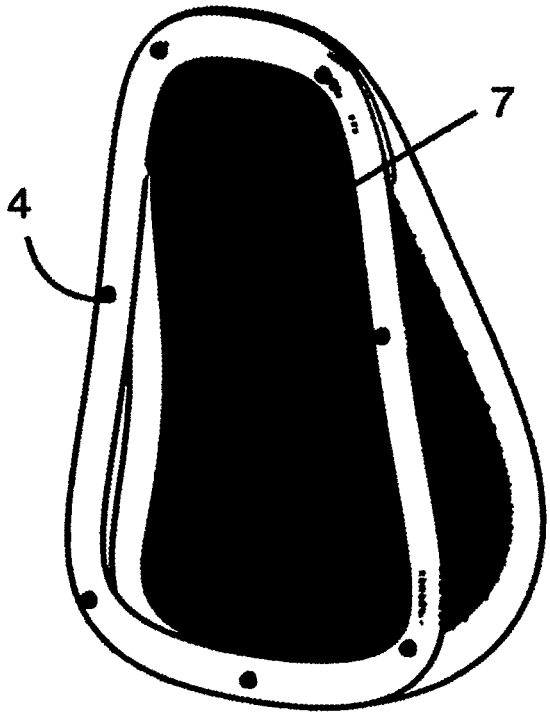
FIG. 3A. Exemplarily illustrates a side view of a back support portion capable of connecting to a backpack portion, with a connecting means such as fastening, snap hooks, or magnets, according to the embodiment shown in FIG. 2A.
Figure 3B:
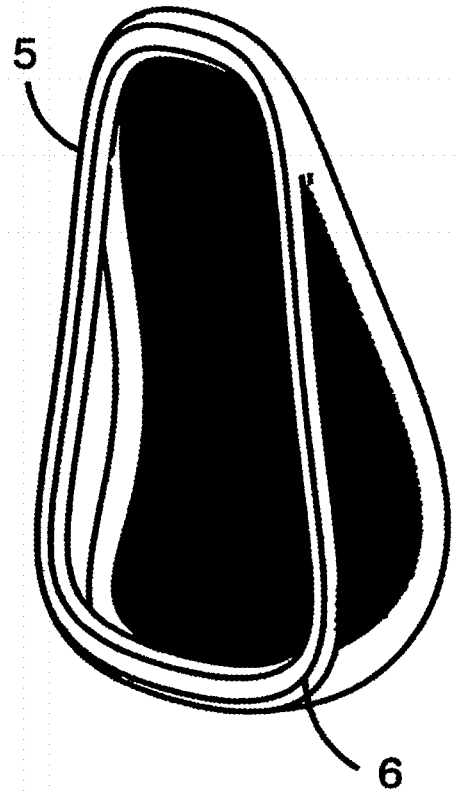
FIG. 3B. Exemplarily illustrates a side view of a back support portion capable of connecting to a backpack portion, with an interlocking connecting means via snapping the perimeter of the frame of said back support portion into the perimeter of the frame of said backpack portion, according to the embodiment shown in FIG. 2B.

1 Backpack 2 Connecting means on backpack illustrating fasteners, snap hooks, or magnets 3 Connecting means on backpack illustrating an interlocking frame 4 Complimentary connecting means for fasteners, snap hooks, or magnets on back support 5 Rigid or semi-rigid frame on back support 6 Complimentary connecting means for interlocking frame on back support 7 Back support

DETAILED DESCRIPTION OF THE INVENTION

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

First Embodiment (FIGS. 1, 2A, 2B, 3A, 3B, 4A, 4B)

One embodiment contains a detachable connection between two portions FIGS. 2A,3A and 2B,3B) that support and are carried on by the spine and trunk. One portion is a backpack FIG. 1 and the second portion is a back support FIGS. 3A,3B which conforms to the anatomy of the back muscles such as the erector spinae. The backpack portion can be made of any material used in prior art such as polyester, nylon, codura, or any other stretchable or non-stretchable materials. The backpack and/or back support portions may contain a rigid or semi-rigid frame to maintain structural integrity 6 and shape under the weight of the user. This frame can be made of materials such as metal, ceramic, plastic composites, or other materials with rigid or semi-rigid properties. The connection between said backpack and back support portions will be secured by a plurality of connecting means 2,4,3,5 not limited to fastening, interlocking, magnetic assembly, vacuum, friction or other means providing a secure and temporary linkage. Said connecting means may also be applied individually or in combination, such as magnetic only or magnetic combined with fastening. The said back support frame 7 can be covered or layered with fabric or similar material for cushioning. The frame and cushioning may also be covered by materials to enhance properties such as friction, heat transfer, and sanitation. Of course, the frame, cushioning, and cover assembly are merely illustrative of one potential embodiment of the backpack and back support portions, and the present invention is not limited thereto.

Operation

Figure 4A:
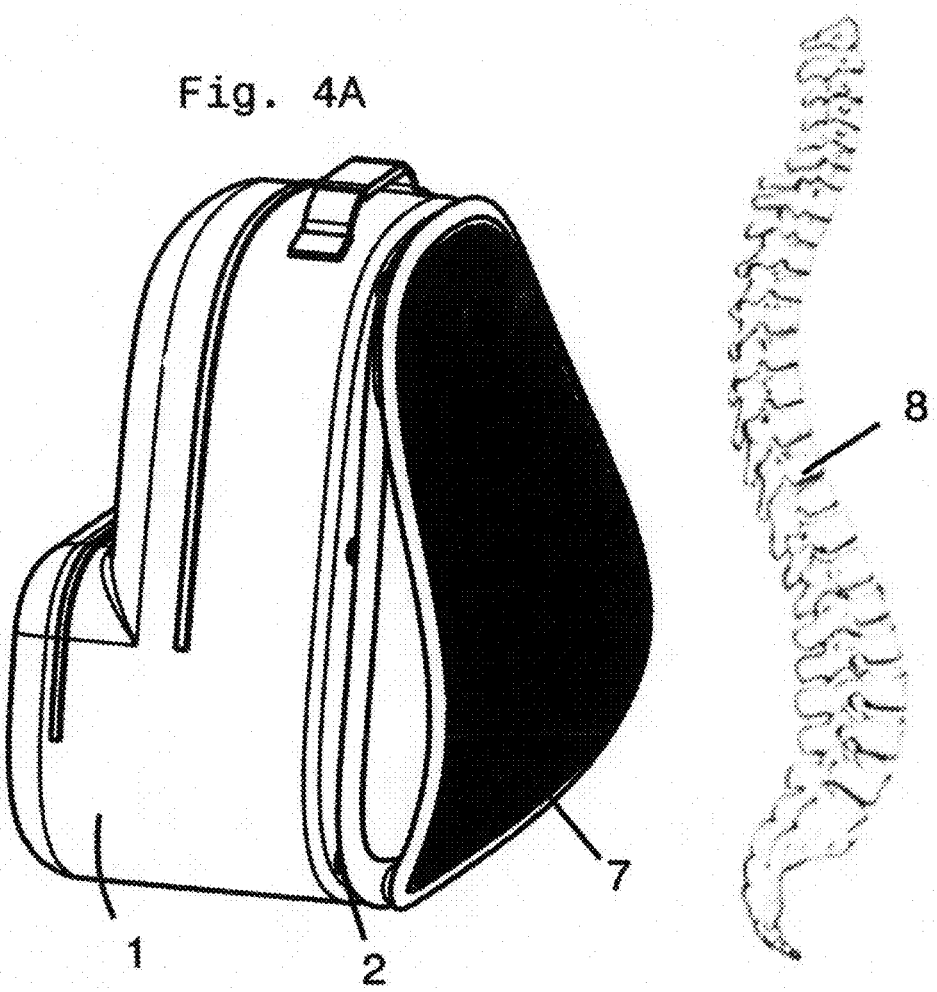
FIG. 4A. Exemplarily illustrates a side view of a backpack and back support portion when connected with a connecting means according to an embodiment shown in FIG. 2A and FIG. 3A.
Figure 4B:
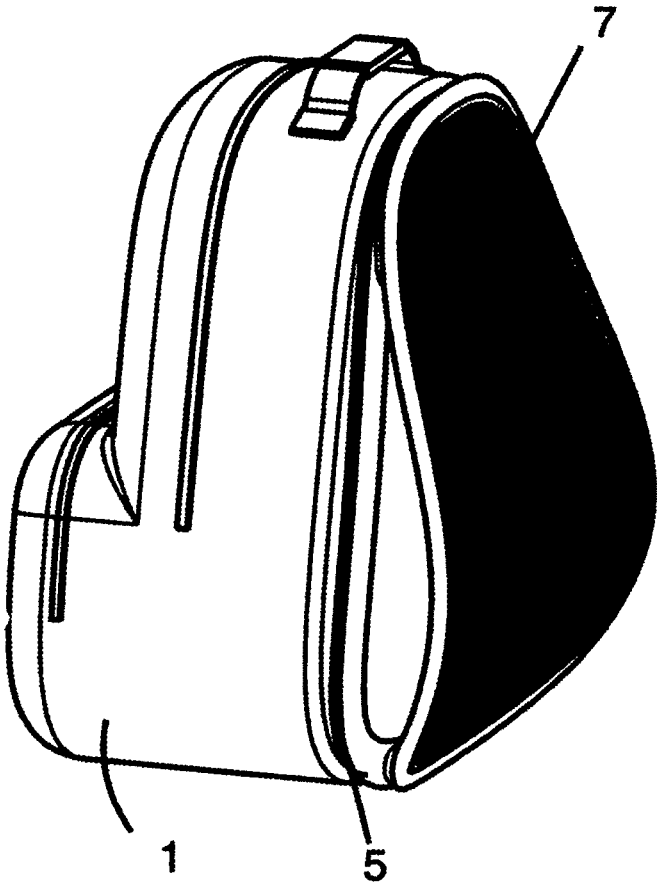
FIG. 4B. Exemplarily illustrates a side view of a backpack and back support portion when connected with a connecting means according to an embodiment shown in FIG. 2B and FIG. 3B.

Operate the two detachably connected portions of this embodiment together FIGS. 4A,4B. Attach the two portions first by securing the connecting means 2,4,3,5. Then operate the two connected portions together in typical fashion for an ordinary backpack by first placing the arms through the shoulder straps. The shoulder straps of the backpack must then be adjusted so that the contour of the back support 7 aligns with the natural curve of the spine 8. This will allow said back support portion of the backpack and back support combination to interface against the spine of the user, providing support and comfort to the spine.

Operate the portable back support portion of this embodiment separately (i.e. apart from said backpack portion). Detach said backpack and back support portions by releasing the connecting means, then remove said back support portion from the backpack and place said back support portion on desired surface such as a chair or seat so that the contour side will meet the curve of the spine FIG. 4A. Pressure and friction created between a seat or chair back and said back support portion under the weight of a user's torso will hold said back support portion in place. Additionally, a means for maintaining position of said back support on a chair or seat not limited to a stretchable and/or adjustable strap as in prior art may also be utilized to further secure said back support portion to a chair Additional Embodiments (FIGS. Not Available)

Additional embodiments of the portable back support portion include said back support with an additional harnessing mechanism. The harnessing mechanism is detachably connected to said back support portion and will allow a user to further secure said back support against the spine both when connected and not connected to a backpack portion. The harnessing mechanism may be secured on the shoulders, torso, and or hips of a user and will be adjustable so a user can loosen or tighten to minimize movement between said back support portion and spine. The harnessing mechanism will be removeable and or releasing if not desired. This would preclude the need for a means for maintaining position of said back support portion on a chair or seat when detached from the backpack portion and would be well suited to carrying heavy loads.

Alternative Embodiments (FIGS. Not Available)

One alternative embodiment includes said back support portion of the First Embodiment with an additional compartment or capacity for carrying or transporting items within said back support portion. This embodiment would also contain at least one detachable and adjustable shoulder strap but does not contain a backpack portion as in the First Embodiment since this back support embodiment would contain its own carrying capacity. The principal advantage of this embodiment is the smaller size and therefore easier portability when larger items do not need to be carried.

Advantages

From the description above, a number of advantages of the several embodiments become evident 1. Reduces barriers to utilization of back supports of prior art since although some back supports claim to be portable, they are not as conveniently portable, since a user must remember to bring and then carry the back support with them throughout the day, inconveniencing the user, and ultimately decreasing utilization. However, since many persons already carry a backpack, a back support which attaches to it would require nothing additional to remember or carry, and consequently, would likely increase utilization, which in turn, would have a more significant impact on alleviating lower back pain. 2. Eliminating the need to purchase both an ergonomic backpack and separate back support since this embodiment dually improves anatomical alignment of the spine while wearing the back support on the backpack and also when the back support portion is detached, allowing one product to serve more than one function. 3. Help prevent back pain in persons who do not yet have lower back pain due to ease of utilization, convenient portability, and unapparent addition to a backpack, potentially mitigating negative stigma of utilizing a back support.

It is also assumed that the advantages of prior are art such as alleviates back pain, reduces repetitive joint stress, improves spinal alignment, and reduces fatigue are evident and encompassed by the embodiment With respect to the above description, it is to be realized that the optimum dimensional relationship for the various components of the invention described above and in FIGS. 1 through 48 include variations in size, materials, shape, form, function, and manner of operation, assembly and use, are deemed readily apparent and obvious to one skilled in the art, and all equivalent relationships to those illustrated in the drawings and described in the specification are intended to be encompassed by the embodiment. Although the embodiment above has been more specifically described, those skilled in the art could introduce numerous variations on the embodiments without differing from the nature or scope of the disclosure or from the appended claims. The embodiment is presented for illustration purposes only and should not limit the scope of the embodiments or its application.

What is claimed is:

1. A combination backpack with removable back support, which comprises:

a backpack portion having at least one storage compartment securable to a user's back, and at least one strap to be worn on a shoulder;

a body side of said backpack portion configured to receive and connect to an attachable back support portion; fasteners releasably connecting said backpack portion to said back support portion, wherein said back support portion contains a supporting frame structure containing at least one elongated member and is comprised of rigid or semirigid material and with fabric material stretched across said supporting frame; wherein said back support portion is configured to conform to the shape of the spine, providing back support to a user;

wherein said backpack portion and said back support portion may be joined together and secured against a user's back collectively, such that said back support interfaces with the back of a user while wearing said backpack portion;

wherein said back support portion is configured to be portable for independent use on a chair or seat when detached from said backpack portion.

2. The combination backpack with removable back support of claim 1, further characterized by a plurality of means for detachably interconnecting said backpack portion to said back support portion.

3. The combination backpack with removable back support of claim 1, further characterized in that said back support is comprised of one or more lightweight cellular materials including soft material such as foam, or a similar type material having foam-like characteristics.

4. The combination backpack with removable back support of claim 1, wherein said back support comprises a means for maintaining position on a chair or seat when detached from the backpack portion.

5. The combination backpack with removable back support of claim 1, wherein the back support portion is constructed to accommodate the torso size of a child or adolescent.

6. The combination backpack with removable back support of claim 1, wherein the back support portion is constructed to accommodate the torso size of an adult.

* * * * *